US008136209B1

(12) United States Patent
Willison

(10) Patent No.: US 8,136,209 B1
(45) Date of Patent: Mar. 20, 2012

(54) SPINNER HANDLE FOR SPORTS' FAN BANNER

(76) Inventor: Christopher H. Willison, Norton, OH (US)

( * ) Notice: Subject to any disclaimer, the term of this patent is extended or adjusted under 35 U.S.C. 154(b) by 143 days.

(21) Appl. No.: 12/419,006

(22) Filed: Apr. 6, 2009

Related U.S. Application Data

(60) Provisional application No. 61/050,697, filed on May 6, 2008.

(51) Int. Cl.
*B25G 1/10* (2006.01)

(52) U.S. Cl. ..... 16/430; 40/218; 446/266

(58) Field of Classification Search ..... 16/430, 16/422, 110.1; 446/266, 236, 242, 265; 116/173; 24/346, 327; 40/647, 218; 223/85
See application file for complete search history.

(56) References Cited

U.S. PATENT DOCUMENTS

| | | | | | |
|---|---|---|---|---|---|
| 2,701,114 | A * | 2/1955 | Donaldson | ..... | 248/315 |
| 3,161,929 | A * | 12/1964 | Swett | ..... | 248/317 |
| 3,755,859 | A * | 9/1973 | Solari | ..... | 223/87 |
| 3,759,398 | A * | 9/1973 | Romney | ..... | 211/46 |
| 4,266,677 | A * | 5/1981 | Dewsnap | ..... | 211/45 |
| 4,398,692 | A * | 8/1983 | Macfie | ..... | 248/309.1 |
| 5,620,118 | A * | 4/1997 | Kolton et al. | ..... | 223/85 |
| 5,904,116 | A * | 5/1999 | Wyner et al. | ..... | 116/173 |
| 7,040,582 | B2 * | 5/2006 | Rosler | ..... | 248/95 |
| 2008/0282960 | A1 * | 11/2008 | Sherrod | ..... | 116/173 |
| 2011/0000051 | A1 * | 1/2011 | Liang | ..... | 16/94 R |
| 2011/0028065 | A1 * | 2/2011 | Arcovio | ..... | 446/242 |

* cited by examiner

*Primary Examiner* — William L. Miller
(74) *Attorney, Agent, or Firm* — John D. Gugliotta, PE, Esq.

(57) ABSTRACT

A spinner handle for waiving a sport's fan banner-towel comprising an ergonomic handle and a banner-towel grasping attachment. The generally elongated cylindrical handle comprises a neck at a distal end which separates it from a rounded head. The neck is received in an aperture formed on an attachment body having two hingedly attached parts that fold onto one another. A corresponding, interlocking stud-and-tube coupling system is comprised on the two attachment body parts. When the parts fold onto one another, the studs are received in the tubes so that a banner-towel placed therebetween doesn't slip out.

18 Claims, 3 Drawing Sheets

SPINNER HANDLE FOR SPORTS' FAN BANNER

RELATED APPLICATIONS

The present application claims benefit of U.S. Provisional Application 61/050,697 filed on May 6, 2008. There are no other co-pending applications, anywhere in the world.

BACKGROUND OF THE INVENTION

1. Field of the Invention

The present invention relates to a sports tower spinner and, more specifically, to a banner spinner handle used by sports fans and other fanatics to show spirit.

2. Description of the Related Art

Sports team's fanatics wave towels and banners in many venues to show support and to rally team momentum. Oftentimes, a sponsored towel is given to every fan at a ticket gate so that they can be waved in unison during a game. The towel is spun at the fingertips by a rotation of the fan's wrist during crucial plays. The towel-banners provide a unique visual effect on viewers when a number of them are spun simultaneously.

The towels, acting as banners, have become novelties similar to fans, pom-poms and inflatable hands. A need is therefore felt to relieve fan's wrists of the strain caused by spinning and therefor allowing extended or more vigorous use. The present invention teaches a spinner handle that provides a fanatic with a means to spin the towel-banner in his or her palm as opposed to the fingertips.

SUMMARY OF THE INVENTION

It is an object of the present invention to teach a spinner handle for a sport's fan banner. It is an object that the present invention removably grasp a towel or a banner so that it can be spun to show spirit. It is an object that the spinner handle provide the fan with a more comfortable ergonomic grasp so that he or she is less strained when spinning the banner-towel.

It is envisioned that a handle comprise either an upper head with a neck that is received in an aperture on a separate attachment body. The attachment body comprises two parts that fold onto one another to clamp the banner-towel at a corner. A movement of the person's wrist causes the aperture to spin about the neck, thus causing the banner-towel clamped in the attachment body to spin too.

In using the present invention a sports fan towel is prevented from wrapping around one's wrist, as it typically becomes entangled because of its inability to spin freely.

BRIEF DESCRIPTION OF THE DRAWINGS

The advantages and the features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

A spinner handle for a sport's fan banner, generally noted as 10 is shown in FIGS. 1, 2*a*-2*b*, and 3*a*-3*b* in accordance with a preferred embodiment of the present invention. The spinner-handle 10 removably grasps a towel or a banner so that it can be spun to show spirit. The spinner handle 10 comprises an ergonomic arbor 12, connectable to a means to removably grasp a banner-towel 14.

Figure 1:
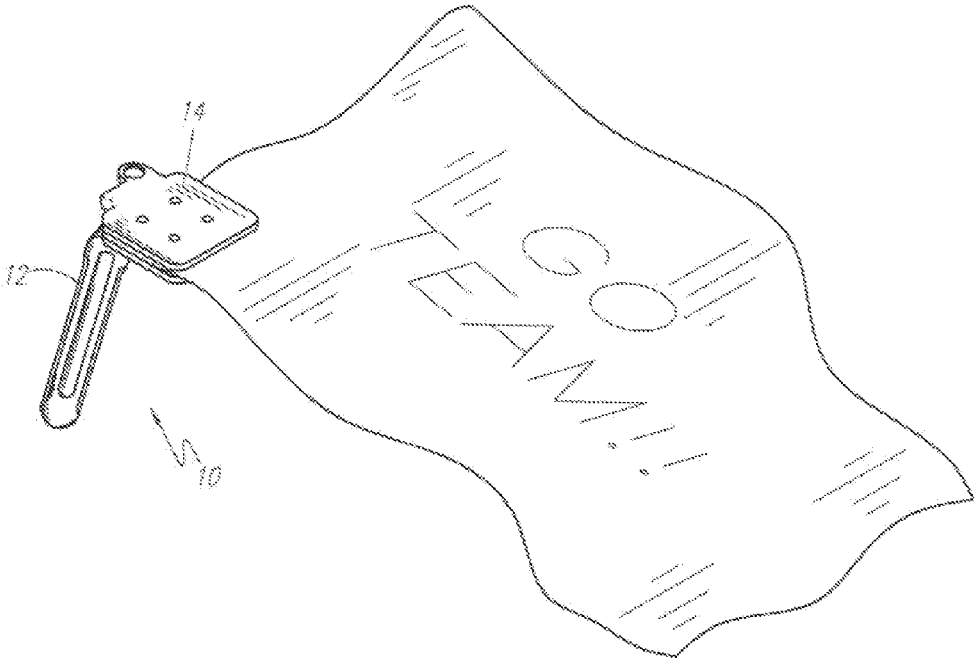
FIG. 1 is a spinner handle and towel in accordance with a preferred embodiment.
Figure 2A:
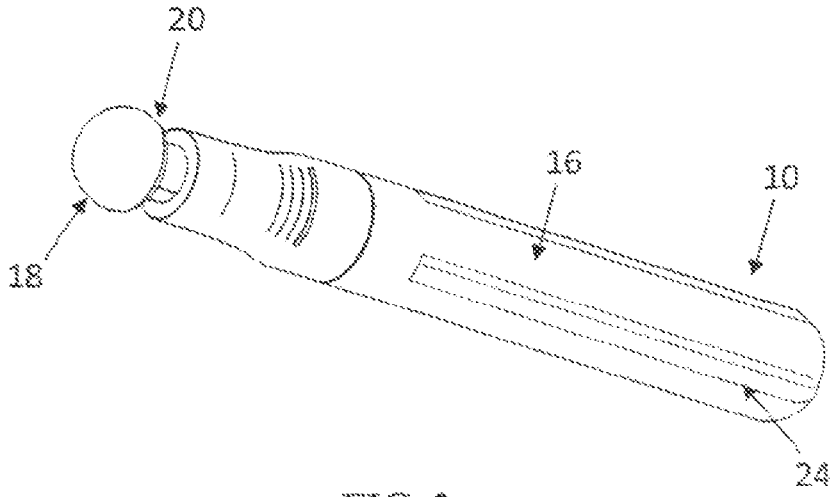
FIG. 2*a* is a detail perspective view of an arbor 12 for use as the handle portion of the spinner handle.
Figure 2B:
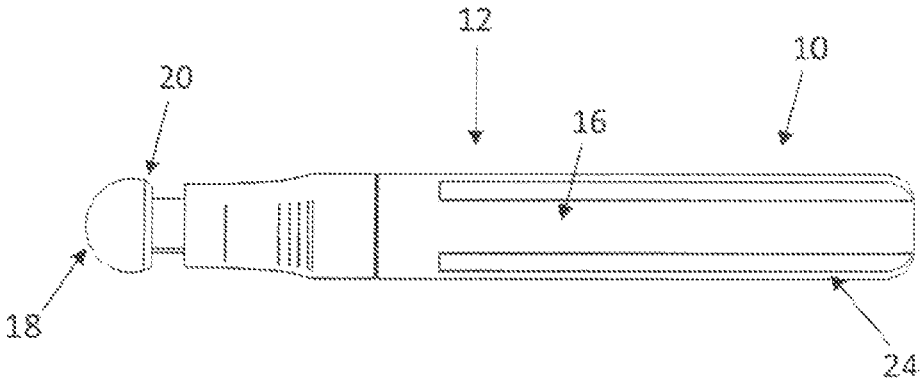
FIG. 2*b* is a side elevational view of FIG. 2*a;*

The arbor 12 is shown in greater detail in FIGS. 2*a*-2*b* to comprise a generally elongated cylindrical body portion 16 with rounded head 18 at one distal end. The head 18 is separated from the cylindrical body portion 16 by means of a neck 20. The neck 20 comprises a circumference that is less than that of both the cylindrical body 16 and the head 18. The neck 20 is received in a slot formed by an aperture 22 (described below) comprised on the attachment body as described in greater detail below. A protective foam sleeve 24 circumscribes the lower body portion 16 of the arbor 12. This provides cushioning for the grip as well as a safety element in order to prevent or minimize injury in the event of unintended or accidental contact.

Figure 3A:
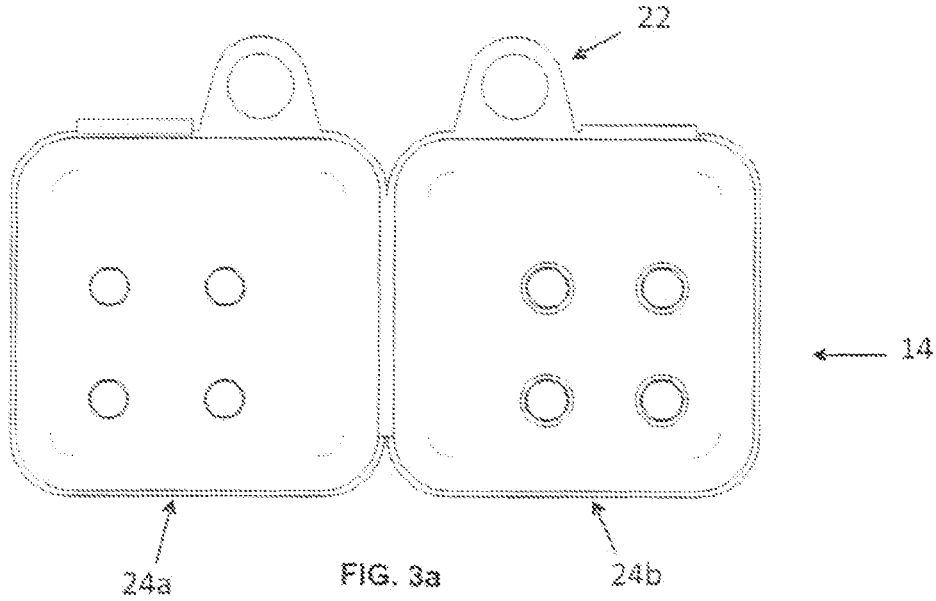
FIG. 3*a* is a detail front elevational view of a means to removably grasp a banner towel 14.
Figure 3B:
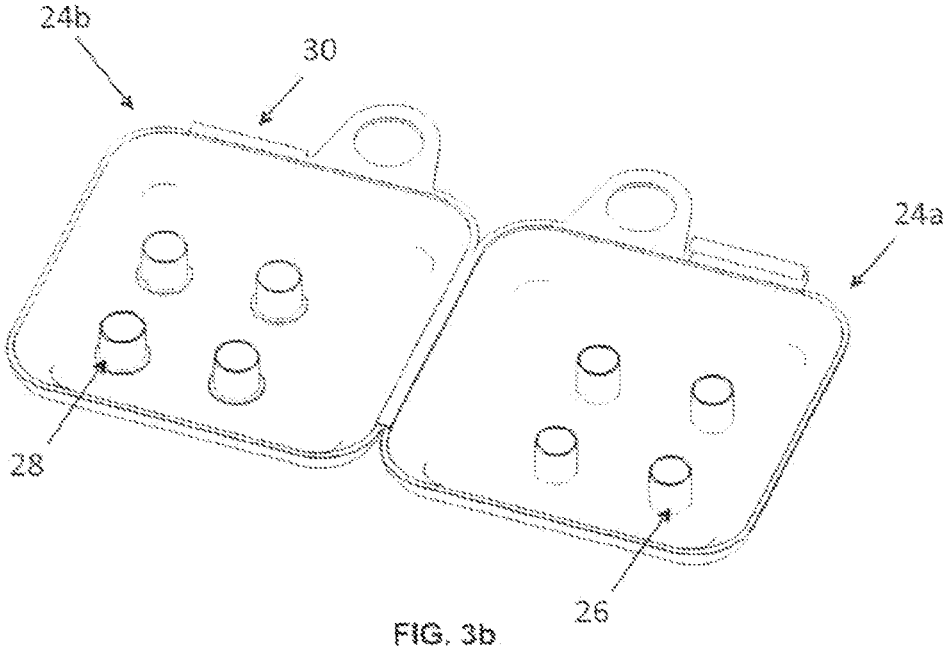
FIG. 3*b* is a detail back elevational view of a means to removably grasp a banner towel 14.

Referring now in conjunction with FIG. 3*a*-3*b*, a means to removably grasp a banner-towel 14 is shown in FIGS. 3*a*-3*b* to be an attachment body (hereinafter referred to as "attachment body 14"). The attachment body 14 comprises an aperture 22 that extends outwards therefrom. The aperture travels around the neck 20 on the arbor 12; hence, it comprises a depth that is less than a length of neck 20 and a circumference that is greater than that of the neck 20.

The attachment body 14 further comprises a locking clasp formed of two corresponding parts 24*a*, 24*b* that form a clam-shell pivotally affixed along an adjacent sidewall or edge such that they may fold onto one another to clamp the banner-towel at a corner. This living hinges enables the clam shell to close repeatedly without compromise to the integrity of the performance of opening and closing over top of the top left corner of any sports fan towel. A movement of the person's wrist causes the aperture to spin about the neck, thus causing the banner-towel clamped in the attachment body to spin too.

To ensure that the banner-towel doesn't "slip" out of the attachment body 14 when it is forced to spin, a corresponding, interlocking stud-and-tube coupling system is comprised on the two attachment body parts 24*a*, 24*b*. At least one stud 26 comprised on a first of the two parts 24*a*, 24*b* is received by a same number of tubes 28 that extend from a second of those two parts. The locking clasp secures the clam shell and locks it in place so that it cannot enable the towel to slip or come loose while spinning.

The spinner handle 10 is shown to comprise four studs 26 and four tubes 28 in FIGS. 3*a*-3*b*; however, there is no limit to any number. The studs 26 extend outwards from a top surface on the first part 24*a* while the tubes extend outwards from the top side of the second part 24*b*. In this manner, a folding of the attachment body 14 at the hinged sidewall forces the coupling. The corner of the banner-towel is secured therebetween.

A lip 30 which extends outwards from the first part 24*a* catches on a reverse underside of the second part 24*b* when the first part 24*a* closes on the second part 24*b*. The lip 30 is shown in FIG. 3*b* to only travel a portion of a length of the sidewall, but it may travel around the entire outer peripheral edge.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined broadly by the drawings and descriptions herein and their equivalents. Therefore, the scope of the invention is to be limited only by the following claims.

Having thus described the invention what is claimed as new and desired to be secured by Letters Patent is as follows:

1. A spinner handle for waving a sports' fan banner-towel, comprising:

an ergonomic handle;

a banner-towel grasping member pivotally engaged with said handle; wherein said banner-towel grasping member is an attachment body; said attachment body further comprising two corresponding attachment body parts; and, an aperture that extends outwards from an edge on at least one of said two corresponding parts, wherein said aperture receives said handle such that said banner-towel grasping member is pivotally engaged with said handle;

wherein said two corresponding parts are pivotally affixed along an adjacent sidewall or edge such that they fold onto one another clamping the banner-towel at a corner.

2. The spinner handle of claim 1, wherein said aperture travels around a neck on said handle, said aperture comprises a depth that is less than a length of said neck and a circumference that is greater than a circumference of the neck.

3. The spinner handle of claim 2, further comprising a corresponding, interlocking stud-and-tube coupling system formed on said two attachment body parts, wherein at least one stud formed on a first of said two parts is received by a same number of tubes on a second of said two parts.

4. The spinner handle of claim 3, wherein said stud extends outwards from a top surface on said first part while said tube extend outwards from a top surface of said second part, wherein a folding of said attachment body at a hinged sidewall forces the coupling.

5. The spinner handle of claim 1, further comprising a corresponding, interlocking stud-and-tube coupling system formed on said two attachment body parts, wherein four studs formed on a first of said two parts is received by a same number of tubes on a second of said two parts.

6. The spinner handle of claim 1, further comprising a lip which extends outwards from said first of said two parts, said lip catches on a reverse underside of said second of said two parts when said first part closes on said second part.

7. The spinner handle of claim 6, wherein said lip only travels a portion of a length of a peripheral edge.

8. The spinner handle of claim 1, wherein said handle comprises:

a generally elongated cylindrical body portion;

a rounded head at one distal end; and, a neck that separates said cylindrical body portion and said head.

9. The spinner handle of claim 8, wherein said neck comprises a circumference that is less than a circumference of both said cylindrical body and said head.

10. The spinner handle of claim 8, wherein said neck is received in said aperture formed by said grasping member.

11. A spinner handle for waving a sports' fan banner-towel, comprising:

a handle, wherein said handle comprises a generally elongated cylindrical body portion, a rounded head at one distal end, and a neck that separates said cylindrical body portion and said head and forms a circumference that is less than a circumference of both said cylindrical body and said head;

a banner-towel grasper forming an aperture, wherein said aperture receives said handle such that said banner-towel grasper is pivotally engaged with said handle allowing rotation of said grasped banner-towel thereabout.

12. The spinner handle of claim 11, wherein said banner-towel grasper is an attachment body comprising:

two corresponding attachment body parts; and said aperture that extends outwards from an edge on at least one of said two corresponding parts;

wherein said two corresponding parts are pivotally fixed along an adjacent sidewall or edge such that they fold onto one another clamping the banner-towel at a corner.

13. The spinner handle of claim 12, wherein said aperture travel around said neck on said handle, said aperture comprises a depth that is less than a length of said neck and a circumference that is greater than a circumference of the neck.

14. The spinner handle of claim 13, further comprising a corresponding, interlocking stud-and-tube coupling system formed on said two attachment body parts, wherein at least one stud formed on a first of said two parts is received by a same number of tubes on a second of said two parts.

15. The spinner handle of claim 11, further comprising a corresponding, interlocking stud-and-tube coupling system formed on two attachment body parts in cooperation with said spinner handle, wherein four studs formed on a first of said two parts is received by a same number of tubes on a second of said two parts.

16. The spinner of claim 15, wherein said stud extends outwards from a top surface on said first part while said tube extend outwards from a top surface of said second part, wherein a folding of said attachment body at a hinged sidewall forces the coupling.

17. The spinner handle of claim 11, further comprising a lip which extends outwards from a first of two attachment body parts in cooperation with said spinner handle, said lip catches on a reverse underside of a second of said two parts when a first part closes on said second part.

18. The spinner handle of claim 17, wherein said lip only travels a portion of a length of a peripheral edge.

* * * * *